US008490294B2

(12) United States Patent
Grunert

(10) Patent No.: US 8,490,294 B2
(45) Date of Patent: Jul. 23, 2013

(54) CLEANING DEVICE FOR A COMPONENT OF A HOUSEHOLD WASHER-DRYER

(75) Inventor: Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 886 days.

(21) Appl. No.: 12/224,000

(22) PCT Filed: Jan. 11, 2007

(86) PCT No.: PCT/EP2007/050237

§ 371 (c)(1),
(2), (4) Date: Aug. 13, 2008

(87) PCT Pub. No.: WO2007/093467

PCT Pub. Date: Aug. 23, 2007

(65) Prior Publication Data

US 2010/0223741 A1 Sep. 9, 2010

(30) Foreign Application Priority Data

Feb. 17, 2006 (DE) ..... 10 2006 007 442

(51) Int. Cl.
*F26B 13/00* (2006.01)

(52) U.S. Cl.
USPC ..... 34/595; 34/242; 68/5 R; 15/21.1; 223/67; 165/96; 134/6

(58) Field of Classification Search
USPC .. 34/85, 86, 595, 601, 210, 218, 242; 68/5 R, 68/5 A, 5 B; 8/137; 15/21.1, 77, 320; 223/67, 223/70; 165/95, 96; 134/6, 902
See application file for complete search history.

(56) References Cited

U.S. PATENT DOCUMENTS

| | | | | | |
|---|---|---|---|---|---|
| 2,203,422 | A | * | 6/1940 | Strobridge | 34/527 |
| 2,443,557 | A | * | 6/1948 | Fitpold | 223/67 |
| 2,680,915 | A | * | 6/1954 | Smith | 34/75 |
| 2,680,916 | A | * | 6/1954 | Smith | 34/75 |
| 2,706,346 | A | * | 4/1955 | Smith | 34/75 |
| 2,722,750 | A | * | 11/1955 | Smith et al. | 34/82 |

(Continued)

FOREIGN PATENT DOCUMENTS

| | | | |
|---|---|---|---|
| DE | 101 16 238 | | 1/2003 |
| EP | 160178 | A1 * | 11/1985 |

(Continued)

OTHER PUBLICATIONS

Linteater Buy at www.rewci.com YouTube video dated Oct. 16, 2007 (youtube.com/watch?=jaIB6Xd39dg).*

(Continued)

*Primary Examiner* — Steve M Gravini
(74) *Attorney, Agent, or Firm* — James E. Howard; Andre Pallapies

(57) ABSTRACT

A cleaning device for a component disposed within a process air circuit of a domestic tumble dryer, in particular for a heat exchanger, including a cleaning brush and a drive mechanism including a drive rod for moving the cleaning brush along the component, the cleaning device including a guiding element operatively associated with the drive mechanism for guiding the drive rod, and at least two flexible sealing elements for protecting the drive mechanism against fluff or similar soiling, wherein the drive rod is passed between the at least two sealing elements for movement along the guiding element.

26 Claims, 1 Drawing Sheet

U.S. PATENT DOCUMENTS

| | | | | | |
|---|---|---|---|---|---|
| 2,722,751 | A | * | 11/1955 | Steward | 34/82 |
| 2,833,056 | A | * | 5/1958 | Smith | 34/527 |
| 3,177,592 | A | * | 4/1965 | Meyer | 34/82 |
| 3,300,869 | A | * | 1/1967 | Bergeson et al. | 34/527 |
| 3,733,715 | A | * | 5/1973 | Hales | 34/82 |
| 3,790,987 | A | * | 2/1974 | MacFarland | 15/392 |
| 3,846,816 | A | * | 11/1974 | Gaisser | 396/589 |
| 4,115,891 | A | * | 9/1978 | Wills | 15/71 |
| 4,167,799 | A | * | 9/1979 | Webb | 15/320 |
| 4,167,801 | A | * | 9/1979 | Erbor et al. | 15/354 |
| 4,202,068 | A | * | 5/1980 | Lester et al. | 15/28 |
| 4,269,264 | A | * | 5/1981 | Goeldner | 165/95 |
| 4,310,946 | A | * | 1/1982 | Baker et al. | 15/363 |
| 4,353,414 | A | * | 10/1982 | Leitner | 165/95 |
| 4,361,774 | A | * | 11/1982 | Czech | 310/90 |
| 4,392,267 | A | * | 7/1983 | Tanaka et al. | 15/88 |
| 4,419,784 | A | * | 12/1983 | Lex | 15/344 |
| 4,527,300 | A | * | 7/1985 | Kunde et al. | 15/88.2 |
| 4,667,732 | A | * | 5/1987 | Harding et al. | 165/95 |
| 4,676,301 | A | * | 6/1987 | Sakamoto | 165/95 |
| 4,700,492 | A | * | 10/1987 | Werner et al. | 34/403 |
| 4,819,026 | A | * | 4/1989 | Lange et al. | 399/354 |
| 4,897,892 | A | * | 2/1990 | Bubien | 15/88.2 |
| 4,984,329 | A | * | 1/1991 | Wade | 15/387 |
| 5,369,834 | A | * | 12/1994 | Groen et al. | 15/104.095 |
| 5,383,243 | A | * | 1/1995 | Thacker et al. | 15/104.18 |
| 5,511,269 | A | * | 4/1996 | Watson | 15/22.1 |
| 5,819,354 | A | * | 10/1998 | Alonso et al. | 15/104.05 |
| 5,860,178 | A | * | 1/1999 | Nishimura et al. | 15/77 |
| 6,115,866 | A | * | 9/2000 | Trummer | 15/23 |
| 6,117,200 | A | * | 9/2000 | Berg et al. | 55/287 |
| 6,167,583 | B1 | * | 1/2001 | Miyashita et al. | 15/77 |
| 6,292,971 | B1 | * | 9/2001 | Chaudray | 15/29 |
| 6,427,274 | B1 | * | 8/2002 | Abbott | 7/105 |
| 6,467,120 | B1 | * | 10/2002 | Ziemins et al. | 15/102 |
| 6,467,122 | B2 | * | 10/2002 | Lenkiewicz et al. | 15/320 |
| 6,519,807 | B1 | * | 2/2003 | Thomson | 15/354 |
| 6,658,692 | B2 | * | 12/2003 | Lenkiewicz et al. | 15/320 |
| 6,751,886 | B2 | * | 6/2004 | Chang et al. | 34/96 |
| 6,823,558 | B2 | * | 11/2004 | Lee | 15/391 |
| 7,114,211 | B2 | * | 10/2006 | Elster | 15/24 |
| 7,302,734 | B2 | * | 12/2007 | Nowak et al. | 15/413 |
| 7,305,775 | B2 | * | 12/2007 | Favret et al. | 34/82 |
| 7,337,487 | B2 | * | 3/2008 | Leonardi | 15/29 |
| 7,421,803 | B2 | * | 9/2008 | Charron | 34/380 |
| 7,475,451 | B2 | * | 1/2009 | Lenkiewicz et al. | 15/413 |
| 7,658,804 | B1 | * | 2/2010 | Cano | 134/8 |
| 7,665,227 | B2 | * | 2/2010 | Wright et al. | 34/339 |
| 7,725,975 | B2 | * | 6/2010 | Lee | 15/77 |
| 7,743,683 | B2 | * | 6/2010 | Dayton et al. | 81/52 |
| 7,845,045 | B2 | * | 12/2010 | Lenkiewicz et al. | 15/320 |
| 7,875,833 | B2 | * | 1/2011 | Song | 219/389 |
| 7,921,578 | B2 | * | 4/2011 | McAllister et al. | 34/597 |
| 2001/0047562 | A1 | * | 12/2001 | Lenkiewicz et al. | 15/320 |
| 2003/0005545 | A1 | * | 1/2003 | Lenkiewicz et al. | 15/320 |
| 2003/0037409 | A1 | * | 2/2003 | Lee | 15/385 |
| 2003/0150126 | A1 | * | 8/2003 | Chang et al. | 34/96 |
| 2004/0111821 | A1 | * | 6/2004 | Lenkiewicz et al. | 15/320 |
| 2004/0237247 | A1 | * | 12/2004 | Nowak et al. | 15/340.1 |
| 2005/0022324 | A1 | * | 2/2005 | Elster | 15/24 |
| 2005/0050672 | A1 | * | 3/2005 | Lenkiewicz et al. | 15/320 |
| 2005/0125921 | A1 | * | 6/2005 | Leonardi | 15/29 |
| 2005/0125922 | A1 | * | 6/2005 | Szarawarski | 15/104.2 |
| 2005/0138753 | A1 | * | 6/2005 | Hufnagel | 15/316.1 |
| 2006/0156498 | A1 | * | 7/2006 | Venard et al. | 15/52.1 |
| 2006/0201014 | A1 | * | 9/2006 | Favret et al. | 34/82 |
| 2006/0249177 | A1 | * | 11/2006 | Guajardo | 134/8 |
| 2007/0174982 | A1 | * | 8/2007 | Lin | 15/77 |
| 2009/0094781 | A1 | * | 4/2009 | Lenkiewicz et al. | 15/320 |
| 2009/0119856 | A1 | * | 5/2009 | Onishi | 15/104.066 |
| 2009/0307867 | A1 | * | 12/2009 | Bernard et al. | 15/354 |
| 2009/0314311 | A1 | * | 12/2009 | Mouri et al. | 134/6 |
| 2010/0000114 | A1 | * | 1/2010 | Dalton et al. | 34/389 |
| 2010/0146809 | A1 | * | 6/2010 | Grunert et al. | 34/443 |
| 2010/0223741 | A1 | * | 9/2010 | Grunert | 15/21.1 |
| 2011/0000097 | A1 | * | 1/2011 | Grunert et al. | 34/73 |

FOREIGN PATENT DOCUMENTS

| | | | | |
|---|---|---|---|---|
| EP | 0 468 573 | | | 1/1992 |
| EP | 1666657 | A1 | * | 6/2006 |
| EP | 1959048 | A1 | * | 8/2008 |
| GB | 2226390 | A | * | 6/1990 |
| JP | 60-53199 | | | 3/1985 |
| JP | 4-17793 | U | | 2/1992 |
| JP | 04367697 | A | * | 12/1992 |
| JP | 06091096 | A | * | 4/1994 |
| JP | 06098993 | A | * | 4/1994 |
| JP | 7-136396 | | | 5/1995 |

OTHER PUBLICATIONS

Stardust homes Linteater review published online Aug. 2004.*
Amazon.com customer reviews Gardus RLE202 Linteater 10 piece rotary dryer vent cleaning system pp. 1 of 4 and 2 of 4. printed from the internet on Mar. 16, 2012.*
International Search Report PCT/EP2007/050237, Jun. 2007.

* cited by examiner

CLEANING DEVICE FOR A COMPONENT OF A HOUSEHOLD WASHER-DRYER

BACKGROUND OF THE INVENTION

The invention relates to a cleaning device for a component of the type specified in the preamble of claim 1, which is arranged within a process air circuit of a domestic tumble dryer.

Such a type of cleaning device is known for example from EP 0 468 573 A1, in which a heat exchanger embodied as a working fluid evaporator unit is to be freed of fluff or similar soiling by means of a cleaning brush implemented as a flat brush which is to be moved along one end face of the evaporator unit. By this means it is possible to remove the fluff or similar soiling—at least above a certain depth—reaching as far as the evaporator unit and deposited there as a result of the condensation of the warm humid process air in spite of the provision of a fluff filter within the process air circuit. In this situation, the cleaning brush is moved by means of a drive rod along the end face of the evaporator unit, which is mounted at its opposite end on a crank of a drive mechanism.

BRIEF SUMMARY OF THE INVENTION

The object of the present invention is to improve a cleaning device of the type described in the introduction such that a high level of operational reliability in particular of the drive mechanism for the cleaning brush is ensured.

This object is achieved according to the invention by a cleaning device having the features described in claim 1. Advantageous embodiments with useful and non-trivial developments of the invention are set down in the dependent claims.

With regard to the cleaning device according to the invention, the drive rod of the cleaning brush is to be moved along a guiding element of the drive mechanism which is protected against fluff or similar soiling by way of at least two flexible sealing elements, between which the drive rod is to be passed through and moved along the guiding element of the drive mechanism. In other words, provision is therefore made according to the invention to protect the drive mechanism by way of a sealing arrangement having at least two flexible sealing elements in such a manner that, although on the one hand the drive rod can be moved along its guiding element, on the other hand reliable protection of the drive mechanism against fluff or similar soiling is however ensured. To this end, the two flexible sealing elements are designed to either overlap one another or to butt up against one another in the overlap area with the guiding element for the drive rod. In any case, the two sealing elements are however dimensioned and arranged with respect to one another such that the drive mechanism and also its guiding element for the drive rod are particularly well protected against soiling caused by fluff or similar material.

The overlapping arrangement of the flexible sealing elements in the area where the drive rod is passed through has proved to be particularly suitable in this situation for reliably preventing—with a type of labyrinth seal—the penetration of fluff or similar soiling into the drive mechanism. In this situation, fluff or similar soiling particles can be prevented from passing between the two flexible sealing elements in a particularly reliable manner if the width of the overlap corresponds at least approximately to the diameter of the drive rod of the cleaning brush.

In an alternative embodiment, the two flexible sealing elements can also butt up against one another in the area where the drive rod is passed through. By this means, a particularly flush sealing arrangement of the flexible sealing elements results, such that no fluff or similar soiling particles can be deposited in particular in the area where the drive rod is passed through.

In an idle position of the cleaning brush—corresponding to one of the two outer ends of the guiding element—a through opening is advantageously incorporated inside the sealing elements, through which the drive rod is taken in the idle position. In other words, the two sealing elements in the idle position of the cleaning brush are cut clear in the area of the drive shaft in order that the sealing elements fit flush in this position and can not be permanently deformed.

In a further embodiment of the invention, a control device is provided, by way of which the process air circuit of the domestic tumble dryer is to be shut down during cleaning of the component. In other words, the component should preferably only be cleaned at a time when the process air has been shut down and accordingly no fluff or similar soiling is also being conveyed during the cleaning phase. This ensures that as little fluff or similar soiling particles as possible come into contact with the drive mechanism of the cleaning device.

Finally, it has been shown to be advantageous to move the round brush in a translatory motion by means of the guiding element. In an arrangement of this type, the two flexible sealing elements are particularly simple to manufacture and to arrange with respect to one another in such a manner that no fluff or similar soiling particles are able to reach the area of the drive mechanism through the sealing arrangement which is formed.

BRIEF DESCRIPTION OF THE DRAWINGS

Further advantages, features and details of the invention are set down in the following description of a preferred exemplary embodiment with reference to the drawing, in which.

DETAILED DESCRIPTION OF THE PRESENT INVENTION

Figure 1:
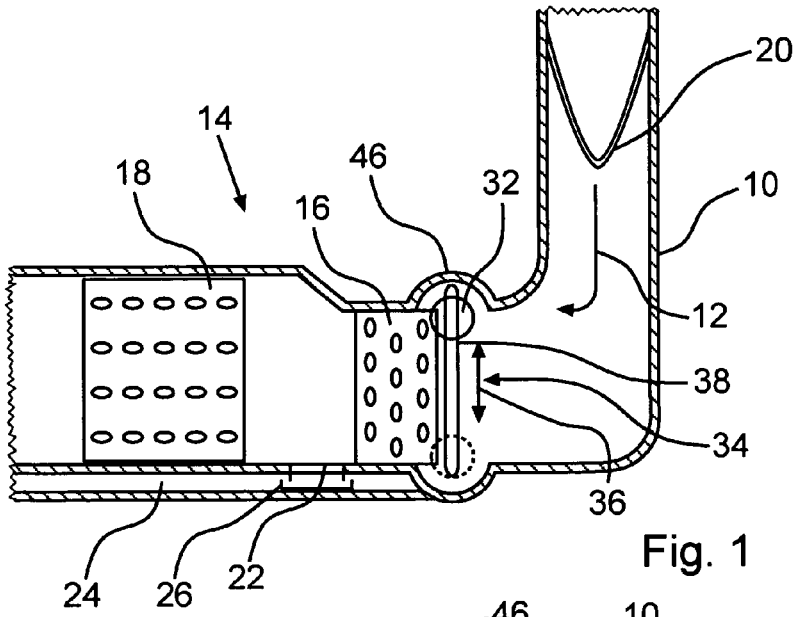
FIG. 1 shows a schematic side view of a partially visible channel of a process air circuit of a domestic tumble dryer and a heat exchanger arrangement located therein comprising a working fluid evaporator unit and a working fluid condenser unit, whereby a cleaning device is provided upstream of the evaporator unit, viewed in the direction of flow of the process air.

FIG. 1 shows a schematic partial side view of a channel 10 of a process air circuit, operated in a direction of flow 12, of a domestic tumble dryer, within which are located a heat exchanger arrangement 14 with a working fluid evaporator unit 16 and a working fluid condenser unit 18. To this end the channel 10 is shown in section. The warm humid process air exiting a washing drum, which is not shown, of the domestic tumble dryer flows first through a fluff filter 20, by means of which a predominant portion of the fluff or similar soiling particles carried along when the air flow passes through the washing drum can be separated out. After it passes through the fluff filter 20, the warm humid process air reaches the working fluid evaporator unit 16 where it is appropriately cooled and dried by means of condensation. The condensate produced in this situation in the area of the working fluid evaporator unit 16 flows by way of an outlet opening 22 to an outlet line 24, from where it is pumped away as process water by means of a pump which is not shown. In the overlap area with the outlet opening 22 a receiving tray 26 is provided, in which fluff or similar soiling particles contained within the condensate can be deposited. The receiving tray 26 should accordingly be removed and cleaned from time to time. The process air cooled and dried by way of the working fluid evaporator unit 16 then reaches the working fluid condenser unit 18 where it is heated up once again and delivered to the washing drum again by means of a fan which is not shown.

Figure 2:
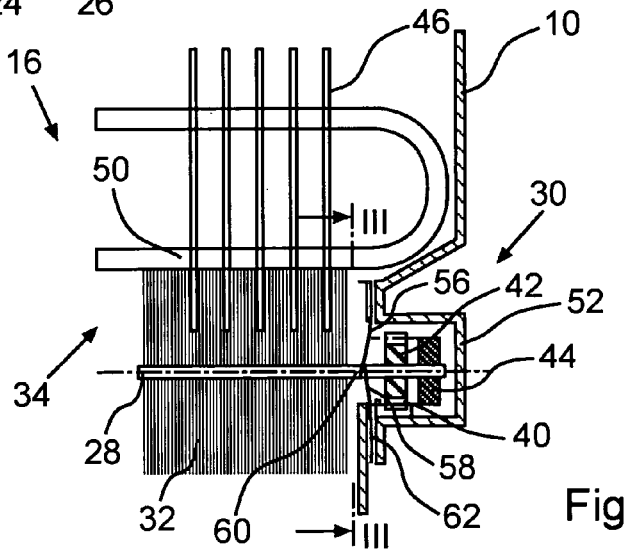
FIG. 2 shows a schematic and partial top view of a cleaning brush, which can be rotated by way of a drive rod of a drive mechanism represented in section, of the cleaning device which is to be moved along the guiding element of the drive mechanism.

Since, in spite of the fluff filter 20, a certain proportion of fluff or similar soiling reaches as far as the working fluid evaporator unit 16 where this would be deposited with the condensate and have a negative influence on the cooling efficiency of the heat exchanger, upstream of the working fluid evaporator unit 16 in the direction of flow 12 of the process air circuit a cleaning device is provided which can be recognized in detail particularly when viewed in FIG. 2. To this end, FIG. 2 shows a schematic and partial top view of a cleaning brush 32, which can be rotated by way of a drive rod 28 of a drive mechanism 30, and which—as can be seen from FIG. 1—is to be moved in the vertical direction between an upper and a lower end position at least approximately along the entire front end face 34 of the working fluid evaporation unit 16 in accordance with the arrow 36. To this end, the drive mechanism comprises guiding elements 38, running in the vertical direction on both sides of the channel 10 in each case, by way of which the drive rod 28 is guided by both its ends. One of the two guiding elements 38 incorporates a toothed rack 40 which can be seen in FIG. 2, in which a toothed gear 42 of the drive mechanism 30 meshes. The toothed gear 42 can be driven by a motor 42 with a transmission, which is likewise arranged at the end of the drive rod 28. By means of the transmission it is possible to operate both the round brush 32 and also the toothed gear 42 by way of the common motor 44. In other words, the motor 42 provides both for the rotary motion of the cleaning brush 32 and also for the latter's translatory motion along the front end face 34 of the working fluid evaporation unit 16 and along the guiding elements 38. In order to enable the front end face 34 of the working fluid evaporation unit 16 to be cleaned of fluff or similar soiling at least almost completely, bulges 46 into which the round brush 32 can plunge are incorporated on the upper side and lower side of the channel 10.

It can be seen from FIG. 2 that the round brush 32 with its bristles, tabs or similar can plunge a certain depth from the end face 34 into the working fluid evaporator unit 16. By preference, the round brush 32 can plunge into the working fluid evaporator unit 16 at least as far as a working fluid tube 50 because experience shows that a great deal of condensate and accordingly also fluff or similar soiling particles are deposited in the area of the working fluid tubes 50.

Figure 3A:
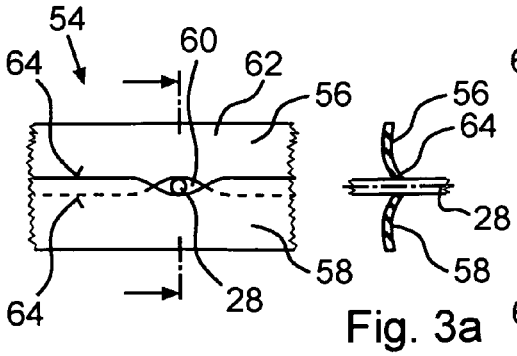
FIG. 3*a* shows a schematic top view of a sealing arrangement for covering the drive mechanism of the cleaning brush along the line III-III in FIG. 2, whereby the drive rod is situated in a position occurring while the cleaning brush is operating.
Figure 3B:
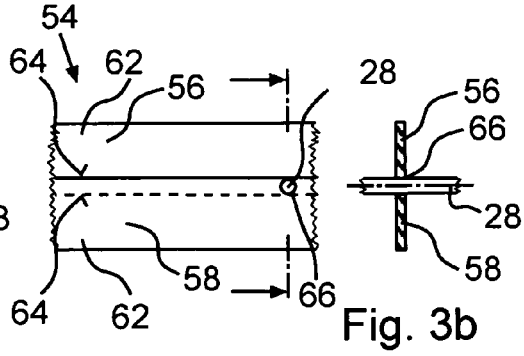
FIG. 3*b* shows a schematic top view of the sealing arrangement along the line III-III in FIG. 2 and in accordance with FIG. 3*a*, whereby the drive rod is illustrated in an idle position of the cleaning brush.

In order to prevent any fluff or similar soiling particles from entering the area of the receiving housing 52—running along one of the guiding elements 38—of the drive mechanism 30, the latter is covered by way of a sealing arrangement 54 explained in further detail in particular in FIGS. 3*a* and 3*b*. To this end, FIGS. 3*a* and 3*b* each show a schematic top view of the sealing arrangement 54 along the line III-III in FIG. 2. In addition, to the right in each of FIGS. 3*a* and 3*b* is shown a sectional view through the sealing arrangement 54 and through the drive rod 28—along the section lines in the left-hand illustrations of the sealing arrangement 54. It can be seen that the sealing arrangement 54 essentially comprises two flexible sealing elements 56, 58 which in the present embodiment consist of two film strips made of flexible plastic. In this situation, the two sealing elements 56, 58 are each implemented in an overlapping manner as a flat strip in the area where the drive rod 28 is passed through 60 (FIG. 2). In this situation, the two sealing elements 56, 58 preferably lie plane and flat on one another. The width of the overlap of the flexible sealing elements 56, 58 corresponds to the diameter of the drive rod 28 in this situation. It would certainly also be conceivable in this context to provide other widths of overlap. As can be seen from FIG. 2, the two sealing elements 54, 55 are secured to the wall of the channel 10 with their longitudinal ends 62 facing away from the take-through 60. It is obvious that the overlap between the two sealing elements 56, 58 should run at least approximately parallel to or coincident with the guiding elements 38 of the drive rod 28 or of the cleaning brush 32. Furthermore, it is obvious that the length of the flexible sealing elements 56, 58 is dimensioned such that the cleaning brush 32 is to be moved at least almost completely along the end face 34 of the working fluid evaporation unit 16. Accordingly, in the present exemplary embodiment the two sealing elements 56, 58 must be at least approximately as long as the guiding elements 38 running vertically at the front and rear end of the cleaning brush 32.

In FIG. 3*b* it can be seen that in an idle position of the round brush 32 a through opening is provided inside the two sealing elements 56, 58—in the area where the drive rod 28 is passed through—in order that the sealing elements 56, 58 in this idle position of the cleaning brush 32 fit flush with one another and can not be permanently deformed. In other words, from the viewpoint of the middle longitudinal ends 64 of the two sealing elements 56, 58 an approximately semicircular recess is incorporated in each case which complement one another in the overlap area or in the area where the drive rod 28 is passed through 60 to form a through opening 66, through which the drive rod 28 is passed. Since the cleaning brush 32 preferably takes up its idle position in an upper or lower end position inside the bulges 46 (FIG. 1), the through opening 66 is preferably provided at the upper or lower end of the sealing arrangement 54. The cleaning device is connected here to a control device which is not shown, by way of which the process air circuit of the domestic tumble dryer is or remains disabled during cleaning of the working fluid evaporation unit 16. By this means the intention is to prevent fluff or similar soiling being conveyed by way of the process air during the cleaning phase of the working fluid evaporation unit 16.

If the cleaning brush 32—in accordance with the arrow 36 (FIG. 1)—is now moved along the end face 34 of the working fluid evaporation unit 16, then the sealing arrangement 54 is deformed in the manner illustrated in FIG. 3*a*. In other words, the drive rod 28 is moved out from the through opening 66 (FIG. 3*b*), as a result of which the two middle longitudinal ends 64 of the sealing elements 56, 58—given close contact with the drive rod 28—are correspondingly deformed. In this situation, the drive rod 28 is moved along the overlap or along the guiding elements 38 (FIG. 1) in such a manner that both sealing elements 56, 58 tightly surround the drive rod 28—at least as far as possible. If a translatory motion with the cleaning brush 32 is accordingly executed in order to clean the working fluid evaporation unit 16, then the drive rod 28 pushes the two sealing elements 56, 58 apart in the area of their respective middle longitudinal end 64. Since the cleaning of the working fluid evaporation unit 16 is completed relatively quickly, there is also no concern of any plastic deformation of the two sealing elements 56, 58 resulting from pushing them apart. In this situation, the middle longitudinal ends 64 preferably become arched upwards—as can be seen from the sectional view in FIG. 3*a*—in the area of the take-through 60 such that it is also not possible for any condensate or similar to enter the drive mechanism 30.

The invention claimed is:

1. A cleaning device for a component disposed within a process air circuit of a domestic tumble dryer, in particular for a heat exchanger, including a cleaning brush and a drive mechanism including a drive rod for moving the cleaning brush along the component, the cleaning device comprising a guiding element operatively associated with the drive mechanism for guiding the drive rod, and at least two flexible sealing elements for protecting the drive mechanism against fluff or similar soiling, wherein the drive rod is passed between the at least two sealing elements for movement along the guiding element, wherein the at least two flexible sealing elements overlap one another in an area adjacent to where the drive rod passes between the sealing elements.

2. The cleaning device according to claim 1 wherein the cleaning brush is configured for rotation by the drive rod.

3. The cleaning device according to claim 1 wherein the overlap has a width, the drive rod has a diameter, and the width of the overlap of the flexible sealing elements corresponds approximately to the diameter of the drive rod.

4. The cleaning device according to claim 1 wherein the at least two flexible sealing elements are formed with respective openings therethrough in an area where the drive rod passes between the at least two flexible sealing elements when the drive rod is at an idle position.

5. The cleaning device according to claim 1 wherein the sealing elements have a length and the length of each of the sealing elements is such that the cleaning brush is moveable substantially completely along an end face of the component by the drive mechanism.

6. The cleaning device according to claim 1 wherein the cleaning brush is movable in a translatory manner.

7. The cleaning device according to claim 1, wherein the guiding element guides the drive rod along a defined path relative to the component such that the drive rod can move only along the defined path.

8. A cleaning device for cleaning attached contaminants from a component disposed within a process air circuit of a domestic tumble dryer, the domestic tumble dryer having airborne contaminants that travel through the process air circuit of the domestic tumble dryer, the attached contaminants being certain ones of the airborne contaminants that are deposited on the component by way of air traveling through the process air circuit of the domestic tumble dryer, the device comprising:

a cleaning brush configured to contact the component and remove the attached contaminants;

a drive mechanism for moving the cleaning brush in a translatory manner relative to the component such that the cleaning brush contacts different locations of the component as the drive mechanism moves the cleaning brush, the drive mechanism including a drive rod attached to the cleaning brush such that translatory movement of the drive rod is transferred to the cleaning brush and causes the translatory movement of the cleaning brush relative to the component, and a motive device attached to the drive rod and proving motive force to the drive rod to move the drive rod and the cleaning brush;

a guiding element operatively associated with the drive mechanism, the guiding element guiding the drive rod along a path of the translatory movement of the drive rod; and two flexible sealing elements configured to stop the airborne contaminants and the attached contaminants from contacting the motive device, wherein the drive rod passes between the two sealing elements and moves relative to the two sealing elements as it moves along its translatory movement.

9. A cleaning device for a component disposed within a process air circuit of a domestic tumble dryer, in particular for a heat exchanger, including a cleaning brush and a drive mechanism including a drive rod for moving the cleaning brush along the component, the cleaning device comprising a guiding element operatively associated with the drive mechanism for guiding the drive rod, and at least two flexible sealing elements for protecting the drive mechanism against fluff or similar soiling, wherein the drive rod is passed between the at least two sealing elements for movement along the guiding element, wherein the flexible sealing elements are in abutment in an area adjacent to where the drive rod passes between the sealing elements.

10. The cleaning device according to claim 9 wherein the cleaning brush is configured for rotation by the drive rod.

11. The cleaning device according to claim 9 wherein the at least two flexible sealing elements are formed with respective openings therethrough in an area where the drive rod passes between the at least two flexible sealing elements when the drive rod is at an idle position.

12. The cleaning device according to claim 9 wherein the sealing elements have a length and the length of each of the sealing elements is such that the cleaning brush is moveable substantially completely along an end face of the component by the drive mechanism.

13. The cleaning device according to claim 9 wherein the cleaning brush is movable in a translatory manner.

14. The cleaning device according to claim 9, wherein the guiding element guides the drive rod along a defined path relative to the component such that the drive rod can move only along the defined path.

15. A cleaning device for a component disposed within a process air circuit of a domestic tumble dryer, in particular for a heat exchanger, including a cleaning brush and a drive mechanism including a drive rod for moving the cleaning brush along the component, the cleaning device comprising a guiding element operatively associated with the drive mechanism for guiding the drive rod, and at least two flexible sealing elements for protecting the drive mechanism against fluff or similar soiling, wherein the drive rod is passed between the at least two sealing elements for movement along the guiding element, further comprising a control device configured to deactivate the process air circuit of the domestic tumble dryer during cleaning of the component.

16. A cleaning device for a component disposed within a process air circuit of a domestic tumble dryer, in particular for a heat exchanger, including a cleaning brush and a drive mechanism including a drive rod for moving the cleaning brush along the component, the cleaning device comprising a guiding element operatively associated with the drive mechanism for guiding the drive rod, and at least two flexible sealing elements for protecting the drive mechanism against fluff or similar soiling, wherein the drive rod is passed between the at least two sealing elements for movement along the guiding element, wherein the cleaning brush is disposed upstream of the component in the direction of flow of the process air circuit.

17. The cleaning device according to claim 8, wherein the path of translatory movement of the drive rod is a defined path, and the guiding element guides the drive rod along the defined path such that the drive rod can move only along the defined path.

18. The cleaning device according to claim 8 wherein the cleaning brush is configured for rotation by the drive rod.

19. The cleaning device according to claim 8 wherein the flexible sealing elements overlap one another in an area adjacent to where the drive rod passes between the sealing elements.

20. The cleaning device according to claim 19 wherein the overlap has a width, the drive rod has a diameter, and the width of the overlap of the flexible sealing elements corresponds approximately to the diameter of the drive rod.

21. The cleaning device according to claim 19 wherein the flexible sealing elements rest against the drive rod where the drive rod passes between the sealing elements.

22. The cleaning device according to claim 8 wherein the flexible sealing elements are in abutment in an area adjacent to where the drive rod passes between the sealing elements.

23. The cleaning device according to claim 8 wherein the flexible sealing elements are formed with respective openings therethrough in an area where the drive rod passes between the flexible sealing elements when the drive rod is at an idle position.

24. The cleaning device according to claim 8 wherein the sealing elements have a length and the length of each of the sealing elements is such that the cleaning brush is moveable substantially completely along an end face of the component by the drive mechanism.

25. The cleaning device according to claim 8 and further comprising a control device configured to deactivate the process air circuit of the domestic tumble dryer during cleaning of the component.

26. The cleaning device according to claim 8 wherein the cleaning brush is disposed upstream of the component in the direction of flow of the process air circuit.

* * * * *